United States Patent [19]

Cowans

[11] 4,004,421

[45] Jan. 25, 1977

[54] FLUID ENGINE

[75] Inventor: Kenneth W. Cowans, Los Angeles, Calif.

[73] Assignee: Ketobi Associates, Tarzana, Calif.

[22] Filed: Nov. 26, 1971

[21] Appl. No.: 202,169

[52] U.S. Cl. ..... 60/516; 60/517; 123/1 R

[51] Int. Cl.[2] ..... F02G 1/02

[58] Field of Search ..... 60/24, 516, 517–526; 123/1 R, 1 A

[56] References Cited

UNITED STATES PATENTS

| | | | |
|---|---|---|---|
| 155,087 | 9/1874 | Hirsch | 60/24 |
| 2,463,130 | 3/1949 | van Weenan | 60/24 X |
| 2,508,315 | 5/1950 | van Weenan et al. | 60/24 X |

*Primary Examiner*—Allen M. Ostrager
*Attorney, Agent, or Firm*—Fraser and Bogucki

[57] ABSTRACT

A hot gas engine is provided that supports internal combustion in a gas mixture maintained at high pressure and in a controlled temperature range. With air as the essential working fluid, an oxygen rich mixture is cycled in a semi-closed loop system supportive of combustion but nonetheless providing work in the fashion of the known Stirling cycle. The arrangement includes a high area, short path length regenerator that contributes to high work efficiency despite the use of a relatively high density working fluid. The high temperature chamber of the system includes an interior layer of self supporting permeable insulation, and confines the working fluid without significant heat loss. An air compressor-expander system is coupled to replenish air in the internal gas mixture at compatible pressures and temperatures and without imposing substantial work loads. Catalytic agents may be disposed in the system for greater burning efficiency. Novel engines thus provided achieve the efficiency inherent in the Stirling cycle, but in compact, lightweight configurations that have short starting time, fast response to throttling, and do not require either a special working fluid or any high temperature metal. The control of temperature and gas mixture generates work from thermal energy with remarkably low levels of accompanying pollutants. The capability for usage of a relatively dense gas as the working medium permits the extraction of energy from hot by-product gases.

15 Claims, 10 Drawing Figures

FIG. 1.
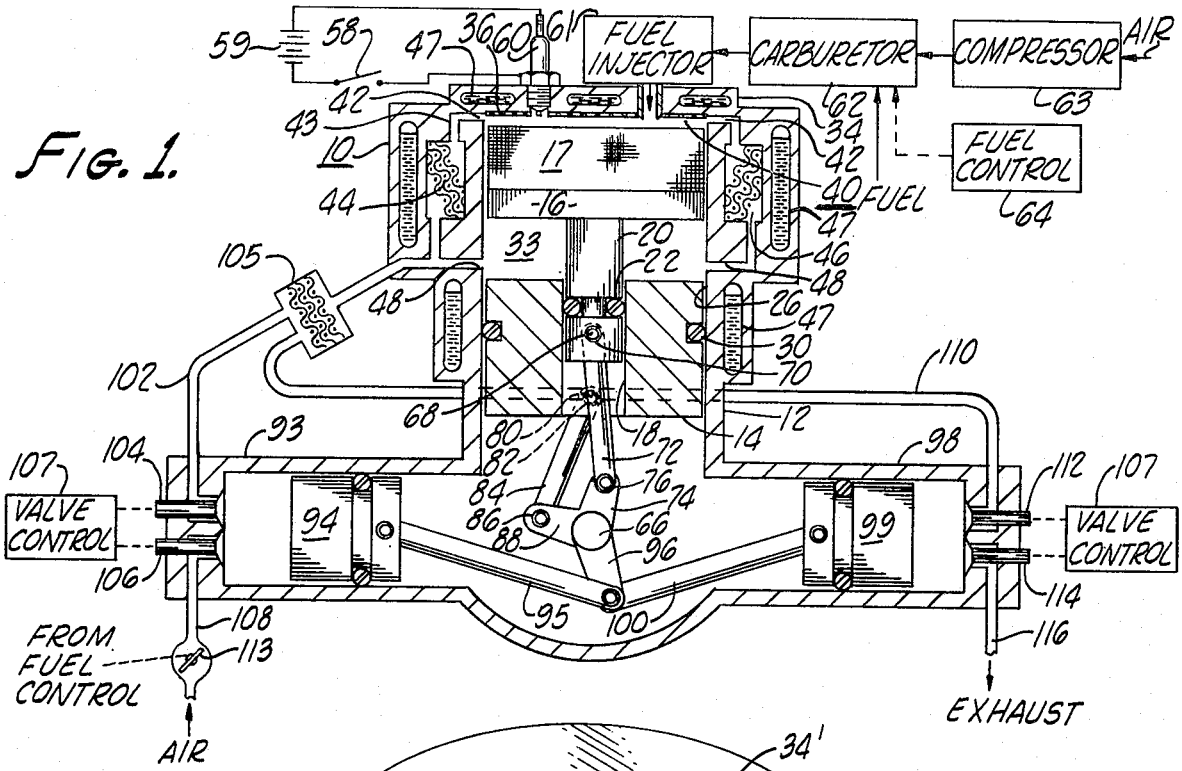
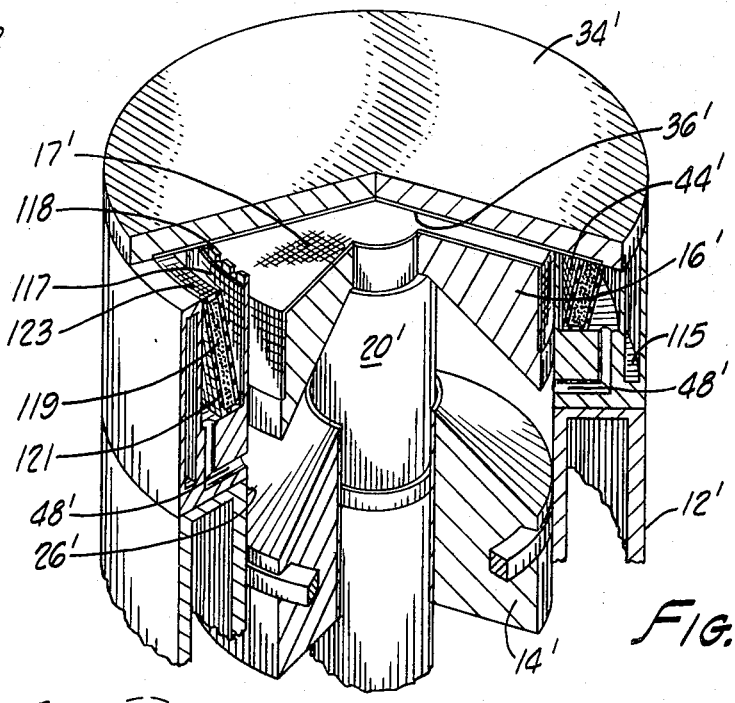
FIG. 7.
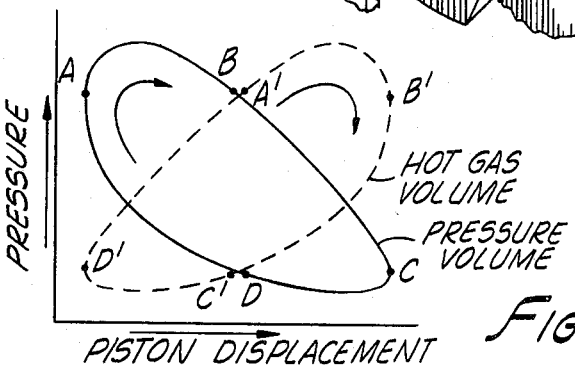
FIG. 6.
INVENTOR.
KENNETH W. COWANS
BY
Fraser and Bogucki
ATTORNEY

FLUID ENGINE

BACKGROUND OF THE INVENTION

This invention relates to fluid engines far deriving work from fluid cycles and more particularly to improvements in Stirling cycle techniques.

There is now a well recognized need for fuel burning engines whose emissions are acceptably free of pollutants. Given fuels that initially have negligible amounts of lead and sulfur, the primary objectionable emissions from modern internal combustion engines are unburned hydrocarbons, carbon monoxide and oxides of nitrogen. Numerous control systems have been devised for conventional engines, based on mixture control, recirculation techniques, emission purification and various combinations of these. While improvements are constantly being made, some mutually contradictory factors prevent rapid achievement of substantially lowered levels for emitted pollutants.

Briefly, these factors are the concurrent need for reasonable power output, pollution control under both transient and steady state conditions, efficient operation and avoidance of unreasonable cost and upkeep penalty. For example, superimposition of controls on existing engines adversely affects both cost and performance. Basic redesign of the common Otto cycle engine to satisfy all requirements does not appear feasible, because these engines operate on an intermittent cycle that is not compatible with efficient burning under widely varied conditions. The Wankel engine, which is in increasing use, inherently does not burn any more cleanly. Recirculation and afterburner systems have been utilized in attempts to reduce levels of pollutants in emissions from both types of engines, and current thinking in the automotive industry appears to regard these corrective systems as necessary if increasingly stringent federal pollution controls are to be met.

Consideration has consequently been given to engines that have inherently superior characteristics in terms of pollution control. One such engine operates on the Stirling cycle, first suggested in the early 19th Century and since used in a variety of applications. The most prevalent current use is in cryogenic systems, in which the work output of the engine is derived in terms of a refrigeration capacity. The Stirling cycle, which need not be reviewed here in detail, utilizes contraction and expansion of heated and cooled intercommunicating gas volumes in timed relation to the extraction of work energy. Engines utilizing this cycle have the additional virtue of generating very little noise. Heretofore, Stirling cycle engines have generally employed external combustion, and although internal combustion was suggested in an early patent to Hirsch, No. 155,087, no present examples of such a Stirling engine are known. External combustion necessitates certain refined techniques to achieve desired efficiency, and these have militated against the use of such engines in vehicles or other applications requiring substantial power generation. External heating of a chamber inherently requires substantial start-up time, and additionally necessitates use of significant amounts of costly and limited high temperature metal (i.e., nickel). Improved efficiency is attained by use of working fluids having low density and high thermal conductivity; helium or hydrogen have been most often used. No convenient mass distribution means is currently available for vehicular users of these gases, which must also be separately stored in the vehicle and thus introduce additional cost factors. In addition, their high thermal conductivities combined with the characteristically relatively constant elevated temperatures of Stirling engines require use of substantial thermal barriers to prevent heat wastage. While the weight and start-up time of the engines can be reduced, there is inevitably a significant penalty in terms of cost and complexity.

In addition there are additional practical considerations when Stirling engines are used in vehicular applications. The work output must be rapidly controllable in order to accelerate and decelerate the vehicle, a factor that requires further special modification of existing systems. Weight, size, power output and work efficiency must reasonably approach or approximate the performance of existing internal combustion systems.

In a Stirling cycle engine that is required to limit oxides of nitrogen, full advantage of theoretical work output cannot be gained because hot gas temperature must be reduced. Particularly if higher hot gas temperatures can be used while the other disadvantages of current Stirling engines are overcome, it is evident that many new applications for the engines exist. For example, the engines may be used for stationary power generating units, or they may be used to extract a substantial proportion of thermal energy available in the high temperature effluent from existing power generating systems.

The state of the art in Stirling engines is evidenced in; addition to the patent to Hirsch, by representative patents such as the following:

Cowans — 3,379,026
Van Nuckeren — 2,484,392
Jonkers — 2,657,552
Jonkers — 2,657,553

SUMMARY OF THE INVENTION

Systems and methods in accordance with the invention provide novel Stirling cycle engines using a low thermal conductivity working fluid, i.e., air, in which combustion may be internally supported. The internal hot gas volume may be closely temperature controlled and held at a high pressure with the air-fuel proportion nonetheless being very high if desired. A permeable insulation structure serving as an interior regenerator between the internal hot gas volume and the adjacent walls of the engine contributes to temperature maintenance without significant heat losses. A novel regenerator arrangement between the high and ambient temperature chambers enables efficient operation without high thermal conductivity gases. Thus, high efficiency and a compact, lightweight construction are achieved concurrently.

In one specific example of an engine in accordance with the invention, hot and ambient chambers of a Stirling cycle engine are interconnected by a large area short path length regenerator that may at least partially comprise catalytic material. The ambient chamber is encompassed by a cooling means and the hot chamber incorporates a ceramic fiber interior layer as permeable insulation. A displacer, also covered with the permeable insulation, is in communication with the hot chamber, and a piston is in communication with the ambient chamber, both being reciprocated in a selected phase relation along the same axis from a common drive shaft. Cooperative means are also provided to initially raise the temperature of the working fluid. A compression-expansion system and throttle control substitutes fresh air for part of the internal mixture in controllable proportions, maintaining the internal pressure and temperature in the selected ranges at selectable work output levels. Burning in the hot chamber may be continuous or in timed relation to the displacer cycle.

The internal gas volume in the high temperature chamber is maintained in the selected working temperature range, but the presence of self supporting permeable insulation at the exposed internal faces establishes a sharp temperature gradient at the chamber wall. Under the existing conditions of small pressure drop and the slow passage of the fluid this material provides an excellent insulating effect. Thus the outer walls can be thin and require relatively little cooling so that high temperature metals need not be used and conductive losses are minimized. The regenerator is shown to have an acceptable pressure loss and heat transfer loss, with air as the working fluid, if the regenerator has a short path length. The fluid velocity through the regenerator, the square of which is proportional to the losses, is shown to be acceptably small if the path length is short (e.g., less than 1 cm.) and thermal storage capacity is supplied by large area. The regenerator may be defined as having a path length-to-area ratio of less than approximately ten times the swept volume with the swept volume expressed in cubic centimeters and the length-to-area ratio expressed in reciprocal centimeters.

An advantageous compressor-expander system is arranged to be coupled into the ambient temperature chamber of the system, and both supplies and receives ambient temperature gas at the working pressure level. The high to ambient temperature ratio is thereby maximized in the engine, achieving a greater efficiency.

Systems in accordance with the invention for the first time provide mass producible Stirling cycle systems suitable for generating and delivering power in vehicular and stationary installations. Pollutants are minimized because the burning process is slow, takes place at relatively low peak temperature and can be adjusted to provide complete combustion, aided by an internal catalyst if desired. These factors together combine to give freedom from unburned hydrocarbons and minimal carbon monoxide and oxides of nitrogen.

A number of aspects of the invention function in cooperative relation to enhance performance and efficiency. The compressor-expander system for constantly refreshing the interior air mixture at pressure may be coupled to the same drive shaft as the engine. The compressor-expander is advantageously arranged with a regenerator communicating between the compression and expansion flows so as to extract thermal energy from the work of compression, thus minimizing the input energy required. The device can be also advantageously arranged as a double ended piston system for better balance and efficiency.

BRIEF DESCRIPTION OF THE DRAWINGS

A better understanding of the invention may be had by reference to the following description, taken in conjunction with the accompanying drawings, in which:

FIG. 1 is a simplified sectional view of an engine in accordance with the invention;

FIG. 6 is a graph of pressure versus displacement for various positions of the piston in an engine in accordance with the invention;

FIG. 7 is a fragmentary perspective view, partially broken away, of the chamber portion of one practical engine in accordance with the invention;

DETAILED DESCRIPTION

Figure 2:
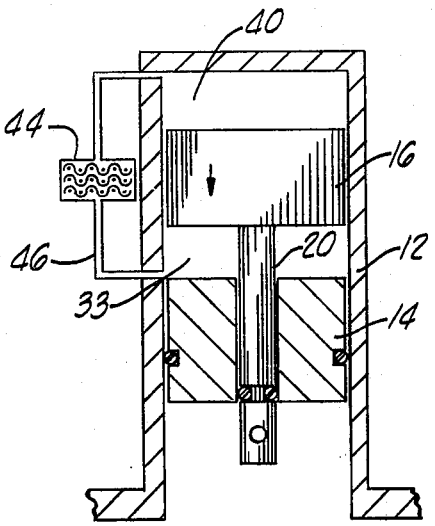
FIGS. 2, 3, 4 and 5 are idealized sectional views of the principal elements of engines in accordance with the invention, showing cyclic operation of piston and displacer elements therein.

A single cylinder Stirling engine is described as used for mechanical output in the following initial example. It will be understood that, as shown hereafter, engines in accordance with the invention can be multicylinder systems incorporating any practical number of cylinders.

FIG. 1 depicts the principal elements of the engine in somewhat idealized form, although specific examples of detailed system features are described below in conjunction with other FIGURES. The engine 10 is disposed within an exterior housing 12 that serves primarily for environmental protection, fluid passage and mechanical support. The reciprocating elements of the engine 10 comprise a piston 14 and a displacer or upper piston 16 mounted along a common central axis, here referred to as a vertical axis although the unit may be operated in any attitude. The displacer 16 has upper and lower working surfaces, the lower surface being in opposed relation to the upper surface of the piston 14. The upper and side surfaces of the displacer 16 are covered with a permeable insulation layer 17, here comprising a thin layer of refractory fiber material. Piston rings (not shown) may be used where displacer size is small or other considerations require; with typical engines the displacer-wall clearance is adequately small to permit operation without such sealing means.

The piston 14 includes a central shaft aperture 18 for receiving in sliding relation a displacer rod 20 whose upper end is coupled to the displacer 16. Fluid flow through the aperture 18 is blocked by a sealing ring 22 in the displacer rod 20. The piston 14 and displacer 16 reciprocate within a single cylinder 26 having a lower or main portion and an upper or displacer portion, respectively. Fluid bypass around the outer periphery of the piston 14 is restricted in conventional fashion by a piston ring 30 in the piston 14.

A working fluid containment volume having two separate variable volume portions or chambers for effecting Stirling cycle operation is defined by this system. Although shown as portions of a single chamber, they may be referred to as individual chambers or containment volumes and may consist of separate but interconnected structures. One volume is that existing between the opposed faces of the piston 14 and displacer 16 within the cylinder 26, and this may be termed an ambient temperature chamber or a pressure volume 33. The volume within the cylinder 26 between the upper surface of the displacer 16 and an upper end bell 34, also having an interior permeable insulative layer 36, is here termed a high temperature chamber 40. Peripheral apertures 42 in the cylinder 26 provide fluid flow through conduits 43 between the high temperature chamber 40 and a cylindrical heat regenerator 44 that encompasses the cylinder 26. An ambient temperature passageway 46 is defined between the regenerator 44 and the pressure volume 33, being in heat interchange relation with a coolant conduit 47 in the housing 12, this flow system being shown only in schematic form. Peripheral apertures 48 interconnect the passageway 46 with the pressure volume 40.

The regenerator 44 is annular about the cylinder bore 26, and as described in greater detail below provides a high area, short path-length, heat storage structure. The unit itself may comprise a metal screen-type, bead-type or other form of regenerator, and in this example is angled relative to the central axis. This structure, as shown below, permits efficient use of high density, relatively low thermal conductivity gas as the working fluid of the engine. The fluid flow takes place in opposite directions between the hot face and the ambient temperature face of the regenerator 44. The ambient face of the regenerator 44 defines the boundary of the ambient temperature passageway 46, which is in turn encompassed by the coolant passageway 47. The inlets, outlets and external radiator system (if desired) for the coolant passageway system have not been shown inasmuch as any conventional form may be utilized. The outer wall of the high temperature chamber is also cooled by the coolant system 47.

A sparkplug 60 or other conventional ignition device powered by a voltage supply 59 and controlled by a switch 58 is mounted in the end bell 34 of the cylinder 26. In the present example, the combustible fuel that is used is lead-free gasoline, supplied to the high temperature chamber 40 through a fuel injector 61 via a carburetor 62 receiving fuel from a supply (not shown) and air from a compressor 63. The fuel is not critical because superior burning conditions are provided; Diesel fuel and propane have, for example, also been successfully utilized in practical examples. To start, air-fuel mixture in proper ratio is fed continuously in while the switch 58 is closed to fire the sparkplug 60. When the high temperature chamber 40 is up to temperature, only fuel is thereafter injected by operation of the fuel control 64 (such as a conventional foot pedal accelerator control), the air supply being separately controlled from the same source to maintain a desired proportion. Details of the fuel injector 61, carburetor 62 and fuel control 64 as well as the remaining elements and the operation thereof, are omitted for simplicity, inasmuch as any of a wide variety of commercially available expedients may be utilized.

The piston 14 and displacer 16 reciprocate in perpendicular relation to the central axis of a crankshaft 66 to which the principal operative elements are coupled. The displacer rod 20 incorporates a lower portion in which is mounted a displacer pin 68, which journals a displacer pin bearing 70 engaged by one end of a displacer connecting rod 72, the other end of which is coupled to a displacer crank arm 74 on the crankshaft 66, through an intermediate bearing 76. The underside of the piston 14 includes an aperture in which is mounted a piston pin 80, substantially parallel to the crankshaft 66 axis, and encompassed by a piston pin bearing 82 registered within one end of a piston connecting rod 84, the opposite end of which is seated on a bearing 86 on a piston crank arm 88 on the crankshaft 66. The crankshaft is seated in two main bearings (not shown in FIG. 1) in the housing 12. The displacer crank arm 74 and piston crank arm 88 are disposed at an approximately 90° phase angle with the displacer crank arm 74 being in phase leading relationship. The working fluid in the various chambers is air; where internal combustion is to be supported for vehicular use this is the obvious fluid, but where combustion is not necessary or other requirements must be met various alternative mixtures may be used.

A throttling system is provided for the provision of fresh air and extraction of combusted mixture in controlled relation to the operation of the system and at pressure levels consistent with the internal pressures. A compressor cylinder 93 receives a compressor piston 94 in reciprocating relation, the compressor piston being driven by a connecting rod 95 coupled to a crank arm 96. An expander cylinder 98 receives an expander piston 99, which is reciprocated by a connecting rod 100 coupled to the crank arm 96 as well. In this example, the piston 94, 99 are shown at the midway points in their stroke, moving in opposite directions. The compressor piston 94 is moving in the direction of compression (to the left in FIG. 1) and an associated valve is about to open; the expander piston 99 is moving in the expanding direction, an associated valve has just closed.

A high pressure air intake tube 102 couples into the pressure volume 33 at at least one peripheral aperture 48 from a compressor exhaust valve 104 through a regenerator 105. Ambient air is supplied into the compressor cylinder 93 through a compressor intake valve 106, the air being derived from an intake conduit 108. The valves 104, 106 are operated in timed relation of the crankshaft cycling, by a conventional valve control 107, details of which have been omitted for simplicity but which may comprise a mechanical or hydraulic system.

A positive exhaust flow is established by the expander piston 99 operation, via a high pressure exhaust tube 110 coupling the pressure volume 33 via the regenerator 105 into the expander cylinder 98 interior through an expander intake valve 112. Both conduits 102, 110 couple into the same side of the regenerator 105. Air is ejected from the expander cylinder 98 through an expander exhaust valve 114 coupling to an ambient pressure exhaust tube 116. The valve control 107 again is coupled to operate the valves 112, 114 in timed relation to the shaft 66 rotation. A throttle device 113, controlled with the fuel control 64, comprises a conventional air flow control valve in the air intake 108.

The general operation of the system of FIG. 1 achieves what is herein termed an internal combustion Stirling cycle. A pressure-temperature relationship that is supportive of combustion as well as consistent with efficient Stirling cycle operation is maintained in the hot gas portion of the system. The internal gas is cycled between the high temperature chamber and the ambient temperature chamber in known Stirling cycle fashion, but comprises a semi-closed system, inasmuch as a portion of the working fluid, which comprises not only air but the products of combustion, is constantly replenished with fresh air.

In the startup mode, as previously described, a combustible mixture is fed into the high temperature chamber 40 as the sparkplug 60 is ignited, until the chamber 40 reaches the desired operating level. Thereafter fuel alone is fed through the injector 61 as the compressor-expander system controls flow of the working fluid. The internal working fluid is maintained at an elevated pressure as well as temperature by the action of the compressor piston 94 which supplies increments of fresh air in cyclic fashion while the expander piston 99 is concurrently operating to remove increments of working fluid from the internal volume.

In very general terms, the crankshaft 66 derives energy from the piston 14, as well as some from the action of the displacer 16. The displacer 16 and piston 14 reciprocate in approximately 90° out of phase relation, displacing the working fluid between the pressure volume 33 and the high temperature chamber 40 with intermediate passage through the regenerator 44 and the ambient temperature passageway 46. Energy to drive the piston 14 and displacer 16 is extracted from heat supplied by the combustion in the temperature chamber 40.

Operation of the system, as well as the Stirling cycle, may be better understood by reference to the diagrammatic representations of the position of the piston 14 and displacer 16 at various points in a cycle of operation in FIGS. 2–5. Reference should also be made to the pressure-displacement graph of FIG. 6 which shows in a solid line curve the pressure variations within the pressure volume or ambient temperature chamber 33 as the piston moves from minimum displacement to maximum displacement positions within the main cylinder 26. The dotted line curve represents the concurrent pressure variations in the high temperature volume.

In FIG. 2, also representing point A on the closed loop solid line curve of FIG. 6, the piston 14 is at the top of its stroke while the displacer 16 is midway on its downward stroke. Thus the pressure volume 33 is at this point in time moving towards its lowest volume, forcing working fluid from the pressure volume 33 through the ambient temperature passageway 46, then through the regenerator 44. Within the regenerator 44, the fluid picks up heat previously deposited, and passes into the high temperature chamber 40, initially under increasing pressure as seen by the curvature between Points A and B in FIG. 6. Movement through the ambient temperature passageway 46 first forces the air to reject the heat of compression, before heating approximately to the level of the high temperature chamber 40 by absorbing heat from the thermal regenerator 44. Between Points A and B (on the solid curve of FIG. 6), the displacer 16 in its midway range is moving faster than the piston 14, so that the bulk of the air in the engine is forced substantially into the high temperature volume chamber 40, before the piston 14 moves substantially downward to expand the volume of the engine. As the downward motion of the piston 14 then continues, the high pressure, high temperature air in the system works against the piston 14, thereby beginning to extract work from the air. Concurrently with the commencement of expansion, the energy extracted in the form of work is replaced by starting the injection of fuel and combustion within the high temperature chamber 40 to maintain the operating temperature level. In the general case, the injection of fuel need not be in timed relation to the cycling of the engine, inasmuch as the basic consideration is that thermal energy be added to maintain the working temperature. Preferably, however, combustion takes place in this expansion phase; such combustion increases the pressure along the upper part of the solid line loop of FIG. 6, thereby increasing the area within the loop and consequently the work performed. Concurrently, the tendency of the gases to cool slightly in the low pressure part of the loop acts to decrease pressure, this effect also contributing to the work output.

Figure 3:
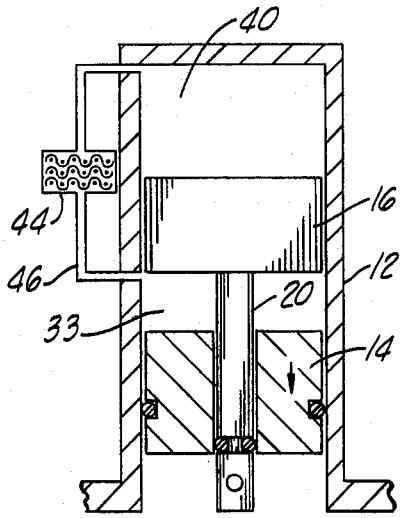
Figure 4:
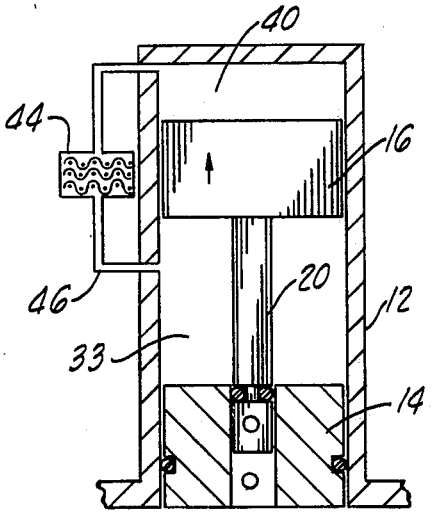
Figure 5:
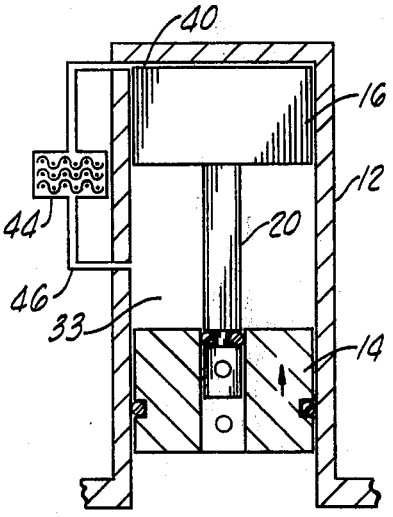

At approximately the time that the displacer 16 is at the low point of its cycle, the piston 14 is midway in its downward travel, as seen in FIG. 3 and at Point B of FIG. 6. Volume in the system has enlarged somewhat, but the volume enlargement is matched to a heating of the air and the pressure is substantially constant relative to Point A. Then, as the piston 14 moves from B to C (from the midway position of FIG. 3 to the bottom or maximum volume position of FIG. 4), work continues to be extracted and the working fluid changes from a somewhat equalized state to a continuing flow from the high temperature chamber 40 back into the pressure volume 33 after passing through the ambient temperature chamber 46. As the cooling of the air continues, there ensues a substantial drop of pressure, as shown by the transition from Point C to D in FIG. 6. During this time the displacer 16 continues upwardly from the midway position of FIG. 4, and the low pressure relationship continues until the displacer again reaches its uppermost point (FIG. 5) and begins moving downwardly. When the displacer 16 thus reverses direction, air begins moving from the ambient temperature passageway 46 back into the high temperature chamber 40 so that the piston position A of FIG. 6 and of FIG. 2 is again achieved, and the cycle can again be repeated. Maximum pressures in the working volume may range from 100–300 atmospheres. Temperature in the high temperature chamber 40 will be in the 1000°–1700° F. range in this example, to limit oxides of nitrogen.

The operation of the system is to be contrasted to conventional internal combustion engines using the Otto cycle, in which the forces generated by the internal explosion impact upon the piston and cause the displacement of the piston to effect work of the crankshaft. The system is also to be contracted with prior Stirling cycle engines, in which thermal energy must be transferred through the wall and then internally within the working fluid. Systems in accordance with the invention establish a high temperature-high pressure confined volume of gas, using a heavy gas having relatively low thermal conductivity, which can therefore include oxygen, so as to be supportive of combustion. The system is effectively a semi-closed loop gas system maintained in an essentially steady state condition, in a mechanism that can effectively utilize the thermal energy of the mixture.

By this arrangement, internally generated or supplied thermal energy is used directly for the generation of work. The substitution of fresh air for a part of the working fluid does not act to cool the heated internal gas volume because the substitution is made in the ambient temperature chamber. Furthermore, by use of the regenerator arrangement in the compressor-expander system, the pressurized fluids to be exchanged are at ambient temperature as well. Therefore, there is no tendency to raise the temperature of the ambient temperature chamber, which increase would reduce engine efficiency unless the hot gas temperature were raised to preserve the ratio. Moreover, engines in accordance with the invention have excellent response rates. Where a change in the torque output level is desired it is effected simply by a change in the air input rate, accompanied by a corresponding change in the fuel input rate. Control is exercised directly on the working fluid by changing the pressure and also the temperature if desired.

Applicant herein shows that, contrary to the most generally accepted view, a low density working fluid is not required for efficient operation of a Stirling cycle engine. Although air was initially used in such engines, the low efficiencies were a principal reason that steam engines supplanted the Stirling engine. The relative expressions "low density" and "high thermal conductivity" gases are intended here to refer essentially to helium and hydrogen, in contrast to oxygen, nitrogen, air and heavier gases. The expressions "high density" and "low thermal conductivity" are therefore intended to refer to gases having a molecular weight substantially in excess of 4. Applicant has in fact ascertained that with use of regenerators and permeable insulation as set out herein high density fluids are preferable as resulting in relatively increased insulative effectiveness without diminishing regenerator efficiency. As shown below, a relation between the two main sources of regenerator inefficiency and characteristics of the flow through the regenerator discovered by applicant results in this conclusion.

The regenerator and permeable insulation discussed herein are intimately related thermodynamically. Permeable insulation with an entrapped gas owes its effectiveness to two factors: (1) the low thermal conductivity of the gas within the insulation, and (2) the action of the insulation in preventing the gas from developing any velocity forces and transferring heat by convection. To the degree that the gas does develop such velocity, heat is transferred between the gas and the insulator as in a regenerator. The permeable insulation of the engine described herein provides a particularly clear illustration of this similarity. Because of the substantial pressure changes in the engine, the permeable insulation must permit some gas flow therethrough in response to the pressure changes or be destroyed thereby. As a mass of gas is transported — in response to pressure increase - from the permeable insulator surface, which might be at 1500° F., to the midpoint, whose temperature is approximately 800° F., the gas will have been cooled during its passage by contact with the intervening insulator material. As the gas returns in response to a pressure decrease the stored heat is regained by the gas. This is the manner in which a thermal regenerator operates. Therefore, the following treatment applies both to the regenerator and the permeable insulation in the engine herein.

The two basic losses in efficiency which occur in conjunction with fluid flow in a thermal regenerator (which is related to the permeable insulation concept as shown below) are due to: (1) pressure drop as the fluid passes through the regenerator; and (2) heat transfer loss due to the inefficiency of the heat transfer process.

The pressure drop ($\Delta P$) is a work loss that is conventionally related to gas parameters of flow by the Fanning equation:

$$\Delta P \equiv \frac{f \rho V^2 l}{2 r_h} \qquad \text{Equation (1)}$$

f Fanning friction factor
$\rho$ gas density
V velocity of gas in regenerator
l length of gas passage
$r_h$ hydraulic radius of regenerator matrix The heat transfer loss is a heat loss that is conventionally related by a basic definition equation:

$$\lambda \equiv \frac{\Delta T}{\delta T} \approx \frac{h}{C_p \rho V} \frac{l}{r_h} \qquad \text{Equation (2)}$$

$\lambda$ "Number of transfer units" or dimensionless heat transfer potential of regenerator heat.
$\Delta T$ Temperature difference from one end of the regenerator to the other.
$\delta T$ Temperature difference between the gas and the regenerator matrix at any point in the regenerator.
$h$ Newtonian heat transfer coefficient.
$C_p$ Specific heat of the flowing gas at constant pressure.

The loss that is found in the pressure drop is a work loss described by the following equation:

$$\text{Work} = \phi \Delta P dV \qquad \text{Equation (3)}$$

where $V$ is the volume flow of the gas through the regenerator. A simpler expression of $\Delta P$ loss that is not too inaccurate is:

$$\text{Work} \approx \frac{\bar{m}}{\bar{\rho}} \overline{\Delta P} \qquad \text{Equation (4)}$$

Where
$m$ average mass flow
$\rho$ average gas density
$\Delta P$ average gas pressure drop Similarly the heat transfer loss can be approximated by:

$$\text{Heat} \approx \bar{m}\, C_p\, \overline{\delta T} \approx m\, C_p \frac{\Delta T}{\lambda} \qquad \text{Equation (5)}$$

A useful relation between the heat transfer and pressure drop can be derived by dividing equation (1) by equation (2) and simplifying to give:

$$\frac{\Delta P}{\lambda} K' \rho V^2 \qquad \text{Equation (6)}$$

Where K' a multiplying factor. Equation (6) is a very useful expression of a regenerator performance in simple terms. It shows the product of the two losses as a simple function of the flow parameters. Since the pressure drop loss is proportional to $\Delta P$ and the heat transfer loss is proportional to $^1/\eta$ then equation (6) is simply $$[\text{Pressure Drop Loss}]\,[\text{Heat Transfer Loss}] = K' \rho V^2 \qquad \text{Equation (7)}$$

K' contains all the factors needed to reduce the above equation. What makes the relation useful is that $K' \sim f/j$ where $f$ is as shown in Equation (1) Equation (8) and j is the standard Colburn factor, $$\frac{h}{C_p \rho V}\left(\frac{C_p \mu}{k}\right)^{2/3}$$

(or the Stanton number times the ¼ power of the Prandt1 number), where $\mu$ viscosity and $k$ thermal conductivity The ratio of $f/j$ is approximately constant for any given type of regenerator geometry.

From equation (6) it would appear desirable to use a low density gas as the working fluid in the engine described herein, since the low density would make for a low loss product. This is not true, however, because it is not necessary that the velocity, V, be constant. For a fixed regenerator volume, $v_o$:

$$V \sim \frac{1}{S} \sim \frac{l}{\sqrt{v_0}} \qquad \text{Equation (9)}$$

S Crossectional area of flow in regenerator l Length of regenerator

Therefore, we can adjust V to be of any value we desire simply by suitably adjusting the aspect ratio S/l. Thus, we can keep $\rho V^2$ to within desirable bounds.

There is a limit to how far this can be carried. This limit is found in the heat $Q\kappa_{reg}$, that is conducted across the regenerator length, which is given by:

$$\dot{Q}\kappa_{reg} = \kappa_{reg} \frac{S}{l} \Delta T \qquad \text{Equation (10)}$$

Where $\kappa_{reg}$ is the thermal conductivity of the regenerator. A reasonable approximation for $\kappa_{reg}$ is $$\kappa_{reg} \approx 3\kappa_{gas} \sim (\rho_{gas}) - 1 \qquad \text{Equation (10A)}$$

This is not strictly correct but is accurate enough for this analysis. Then, if we adjust $\rho V^2$ to be equal for two gases of different densities:

$$V \sim \frac{1}{S} \sim \frac{1}{\sqrt{\rho}} \qquad \text{Equation (11)}$$

Thus:

$$\frac{l}{S} \sim \frac{l}{\sqrt{\rho}} \sim \frac{v_0}{S\sqrt{\rho}} \sim \frac{v_0}{\rho} \qquad \text{Equation (12)}$$

so that the heat transferred by equation (10) is:

$$\dot{Q}\kappa_{reg} \sim \kappa_{reg} \frac{\rho}{v_0} \Delta T \qquad \text{Equation (13)}$$

and; since $\kappa_{reg}$ by (10A) is $$\text{is} \sim \frac{1}{\rho}, Q\kappa_{reg}$$

is invariant with density if the other loads ($\Delta P$, $\lambda$) are adjusted to be equal for the two gases.

The analysis given above has indicated that the change of gas density can in fact have essentially no effect upon the efficiency of the engine. This is in contrast to accepted suppositions that state that the higher thermal conductivity (low density) is needed in the working gas.

The permeable insulation on the other hand, has an effectiveness that is inversely proportional to its thermal conductivity ($\kappa_{reg}$ in equation (10A) and directly to its thickness. Therefore, for a given amount of heat loss through this insulation a heavy gas will provide a higher efficiency than will a light gas if a given amount of volume is allotted to this insulation.

Thus, the present invention utilizes the previously unrecognized facts that a relatively high density gas can be used without reducing regenerator efficiency while providing higher insulative efficiency.

Applicant's teaching thus permits utilization of a relatively dense gas as a working fluid for a Stirling engine without sacrificing heat transfer efficiency in the regenerator.

The permeable insulation 17 may comprise ceramic or refractory fibers, or fabrics, steel wool, rock wool or high temperature resistant gas permeable material. Such insulation comprises a finely divided, volume distributed structure which fixes a gas within it. The fixed gas cannot readily transfer heat because it is prevented from developing a significant velocity near the surrounding structure. The surrounding structured material is of low density and is of low thermal conductivity as is the fixed gas, such as air. Thus, a very effective insulation results having approximately the thermal conductivity of air.

This type of insulation is particularly useful in the present engine. The metal outer walls of the high temperature chamber 40 can be relatively thin and are readily cooled by the associated coolant liquid. In the working volumes of this engine there are not only high temperatures (such as 1700° F.) but there is substantial cyclical variation of temperature and pressure. Permeable insulation responds to pressure fluctuation with movement of the internal gas, which in effect absorbs the stresses imposed by such fluctuations. These stresses tend to disintegrate a rigid insulator. The heat transfer effect of this gas movement is minimized because of the transfer of heat between the interior gas and the surrounding structure in the manner of a regenerator. The effectiveness of permeable insulation, of course, increases with density of the heat carrying fluid with which it is in insulation contact; thus, such insulation is especially appropriate for use in conjunction with the relatively dense working fluid of the present invention. Permeable insulation is less heavy and bulky than other types of insulation. For example, in a typical vehicular application, 1/16 inch of interior permeable insulation surrounded by 1/16 inch of steel would be sufficient whereas 2/10 inch of nickel-bearing alloy would be required in a conventional Stirling engine. This comprises a clear economic advantage.

The maintenance of a contained high temperature volume suitable for extraction of work energy by the Stirling cycle, without significant heat losses by conduction, again provides advantageous aspects that may be appreciated by comparison to the functioning of the cylinder wall in the conventional internal combustion engine, either Otto or Diesel type. In such engines, the internal gases are intermittently heated to extremely high temperature and pressures, and come into contact with cold walls to which they give up thermal energy while expanding to a lower pressure. The engine wall must contain both the high temperature and pressure.

The high temperatures attained in conventional internal combustion engines do not afford high efficiency, because the walls and fuel, both of which are much cooler, introduce large heat losses. Even keeping the engine walls hot would introduce no significant improvement because the entering cool air would also act to cool the walls. Due to these effects, internal combustion engines have maximum efficiencies of about 40%. In external combustion engines, the fundamental limitation is the characteristics of the engine wall, which must contain both significant pressures and temperatures. In order to withstand the required pressures, the internal temperature must be kept to about 1000° F. in common practice, limiting efficiency to about 67% in theory and about 40% in practice. Also, due to the necessity for large heat surfaces the engines tend to be large and heavy.

In the present engine, by contrast, the walls of the high temperature chamber are maintained in a hot condition all during the time of operation by operation of the permeable insulation. The gas entering the high temperature chamber is always hot because of the action of the thermal regenerator, which member may be considered a form of permeable insulation. Thus the chamber may be maintained at temperatures in excess of 2500° F. without incurring any large heat losses. The practical efficiency of the engine, using these high temperatures, could extend to 70% or higher. The establishment of a high thermal gradient by the interposition of permeable insulation enables the effective isolation of the interior gas volume and both conserves heat and minimizes size and weight.

The semi-closed cycle nature of the engine can be considered a very significant contribution to insuring thorough burning of the fuel. In a practical example the engine is operated such that gasoline is consumed at a rate equal to 1 mole of gasoline to 18 moles of air being taken into the compressor. The exhaust is then about 4.5% oxgyen, and in order for this to happen the gas within the basic engine must also be 4.5% oxygen. The compressor is arranged to inject 10% of the total volume during each revolution, so than an amount of fuel is used equal to $1/18 \times 1/10$ moles of gasoline per mole of engine gas per revolution. Thus in the engine there are at least $0.045 \times 180 = 8.1$ moles of oxygen per mole of fuel at the instant of fuel injection. This is approximately three to four times as much oxygen as that needed to oxidize the fuel. In addition, the air injected by the compressor contains enough oxygen to oxidize all the fuel so that in practice at least 5 times as much oxygen is present compared to that needed.

Working fluid regenerators utilized in conjunction with engines in accordance with the invention preferably include, or are coated with, catalytic material, to facilitate combustion. An example of an appropriate material is vanadium pentoxide. The conditions for effective catalytic combustion are met in the working volume of engines in accordance with the invention; there is a high ratio of air to fuel, the pressure is high, the temperature is high, and there is large degree of contact between the fuel-air mix and the catalytic surfaces. This engine recycles much of the working fluid many times, with the fuel being injected in small quantities, and fresh air being substituted for working fluid, in cyclic fashion. Thus, the ratio of $O_2$ to unburned fuel is very high (e.g., 20:1 in a typical case), and favors catalytic combustion.

The temperature at which oxides of nitrogen begin to form is approximately 3000° F. To avoid this, where pollution is to be minimized, the internal temperature within engines in accordance with the invention is preferably maintained at an upper limit of approximately 1700° F. for example. Where other considerations prevail, the temperature in the high temperature chamber can be increased. There is little, if any, unburned fuel in engines in accordance with the invention because of extensive recycling of the working fluid. On the average, an increment of the working fluid is cycled ten times before being extracted. Because of the efficient, slow, low temperature combustion of such engines, there are minimal amounts of products of incomplete combustion such as carbon monoxide. Thus, engines in accordance with the invention operate effectively pollution free.

For vehicular applications, the internal gas pressure is preferably maintained in the range of approximately 250 to 1200 psi, taking the pressure at the low pressure point in the cycle at full throttle. In a specific practical example the pressure (under the same conditions) was approximately 750 psi, the low pressure cycle point at idle being in the range of 25 to 75 psi. In the general case, including engines for vehicular uses, the low pressure cycle point at full throttle may be from 100 psi (for a simple engine having a single compression stage) to 3000 psi. The compression ratio, typically in the range of 2:1 to 2.5:1 then determines the level at the high pressure point in the cycle. For vehicular engines, a maximum pressure of approximately 3000 psi is generally observed.

The internal temperature in the hot chamber can be substantially higher than 1700° F., of course, and can go to as much as 4000° F., or as much as the materials used can tolerate. This factor as well as the use of permeable interior insulation is of great importance to use of the engine for extraction of work energy from high temperature working fluids. Discharge of high temperature effluent in vast quantities, as occurs in some industrial installations and in nuclear power generating equipment, constitutes not only a power waste but a significant source of thermal pollution. Systems and methods in accordance with the invention not only can confine internal hot gas volumes without excessive heat loss and massive support structures, but can release thermal energy directly in the high temperature chamber. Combustion is not required for the extraction of work from such a working fluid, only the introduction of such fluid into the high temperature chamber and the emission of fluid from the low or ambient temperature chamber.

Details of a specific piston and displacer mechanism for a Stirling cycle engine in accordance with the invention are shown in FIG. 7, to which reference is now made. In this FIG., the principal elements that correspond to the elements of FIG. 1 are similarly designated, but distinguished by a characterizing prime (′) designation. The displacer 16′ is mounted on the end of the displacer rod 20°, and includes a terminal layer of permeable insulation 17′ on its end surface and about a substantial width of the associated circumference. This permeable insulation 17′ is, in this example, a refractory fiber material (substantially pure silica derived by leaching non-silicous oxides from glass fibers) of the type sold under the trademark designation "Refrasil" by HITCO of Gardena, California. Preferably the material is in fabric form and of the type having a chrome oxide coating and sold as "Irish Refrasil". The height dimension of the displacer 16' tapers to the greatest dimension at the outer periphery of the displacer, to mate generally with a conforming taper on the upper surface of the piston 14'. The piston 14' is tapered in this manner because it functions as a bearing for the displacer rod 20' and the taper introduces a substantially longer bearing length than would otherwise be achieved, thereby minimizing lateral thrust forces that must be absorbed by the system. However, when the rhombic type of drive system used with many Stirling engines is employed, such lateral thrust loads are not encountered.

The interior surface of the end bell 34' includes a layer of insulation 36' of the same character. At the upper end of the interior cylinder wall 26' the housing 12' includes a cylindrical recess in which the annular regenerator 44' is mounted at an angle relative to the adjacent walls. At an outer radius adjacent the regenerator 44', the housing 12' includes a coolant passageway 115. On the outer wall of the cylinder wall in this region there is disposed a layer of permeable insulation 117 of the same type. The upper end of the cylinder wall includes regularly spaced slots 118 providing a discontinuous path for flowing fluid, the slots 118 acting to introduce some turbulent mixing into the flowing fluid. The regenerator 44' comprises a large surface area, short path length device using an interior volume of bead elements 119 contained within facing metal screens 121 at each broad face thereof, and end rings 123 in which the metal screens 121 are mounted. The regenerator 44' is angled relative to the vertical, in the nature of a portion of a frustum, so as to define a tapering volume on its hot face side opposite the permeable insulation 117, and also on its cold face side leading to the conduits 48'.

The arrangement of FIG. 17 is but one practical example of a system of a device in accordance with the invention, and those skilled in the art will recognize that a substantial number of variations of individual elements and general relationships may be utilized. The bead elements 119 comprise typical commercially available, catalyst containing, heat regenerator elements. Specifically they are in the form of vanadium pentoxide dispersed with alumina pellets of approximately 40 mesh size, in this example.

Figure 8:
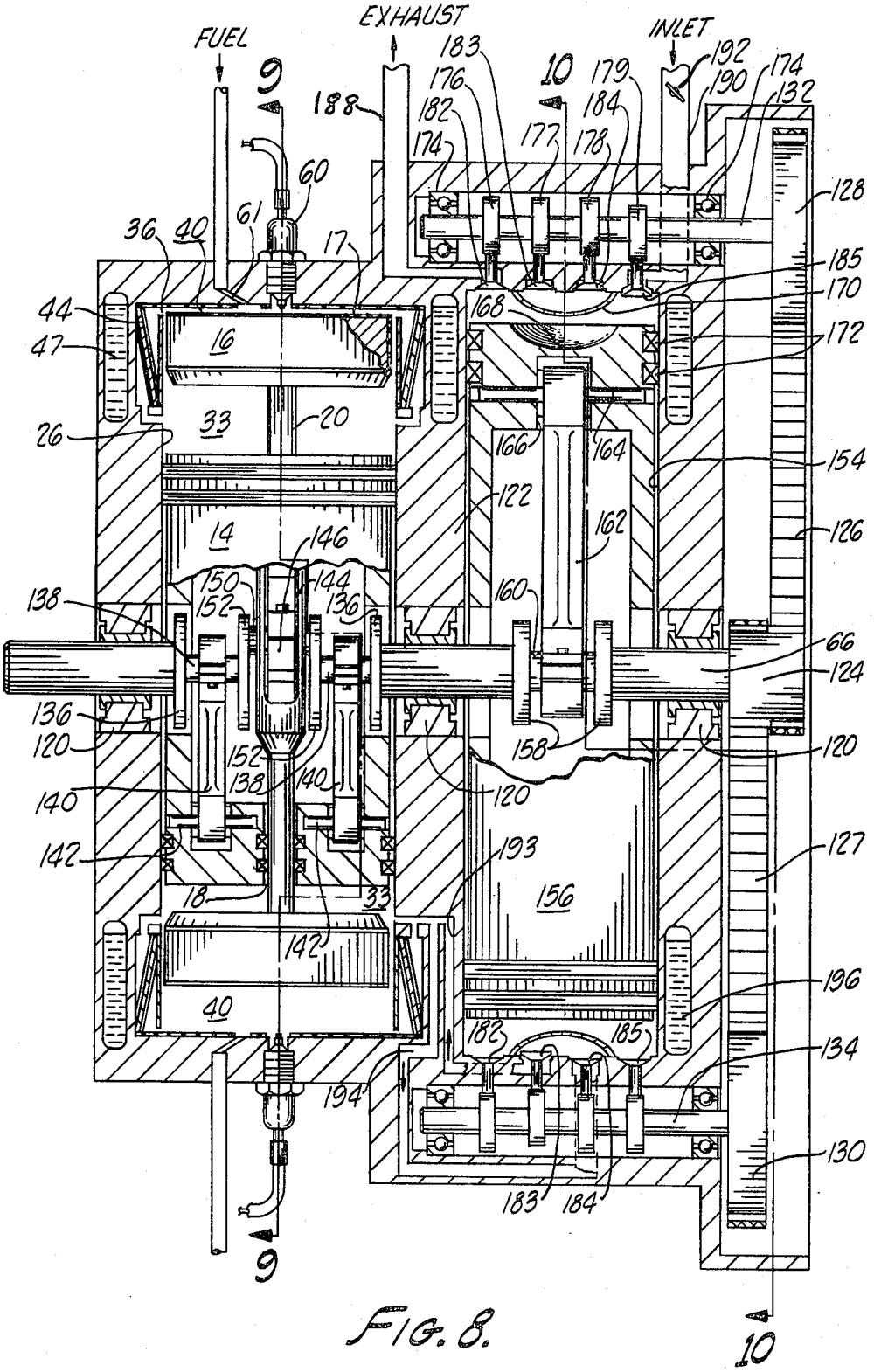
FIG. 8 is a side sectional view, partially broken away, of a two cylinder engine in accordance with the invention.
Figure 9:
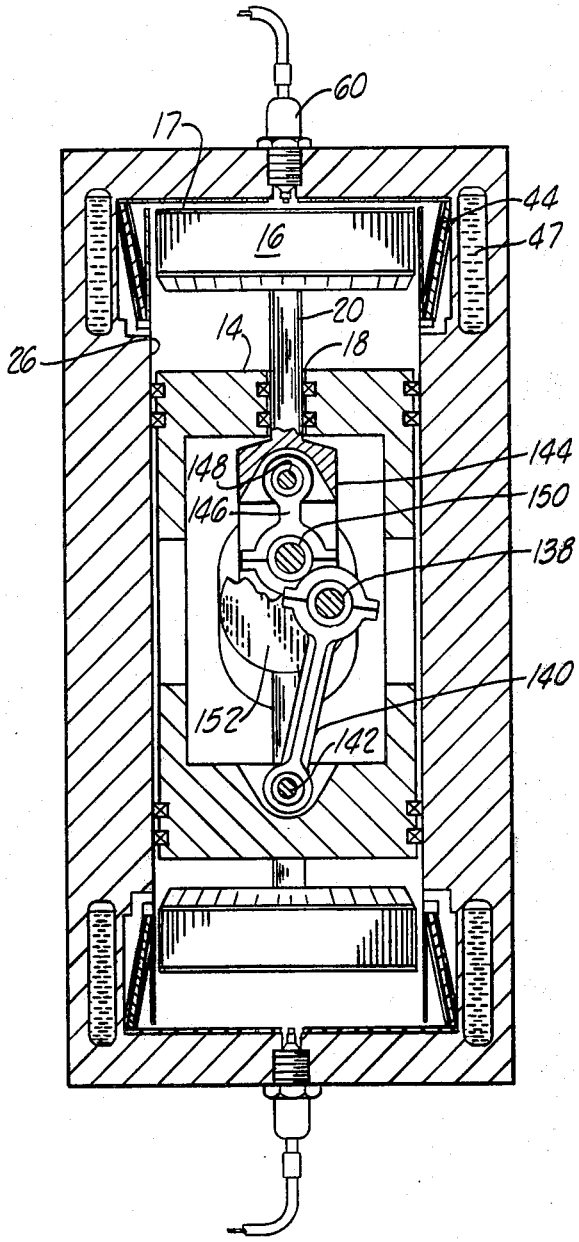
FIG. 9 is a side sectional view, partially broken away, of the engine of FIG. 8 taken along the line 9—9 in FIG. 8 and looking in the direction of the appended arrows.
Figure 10:
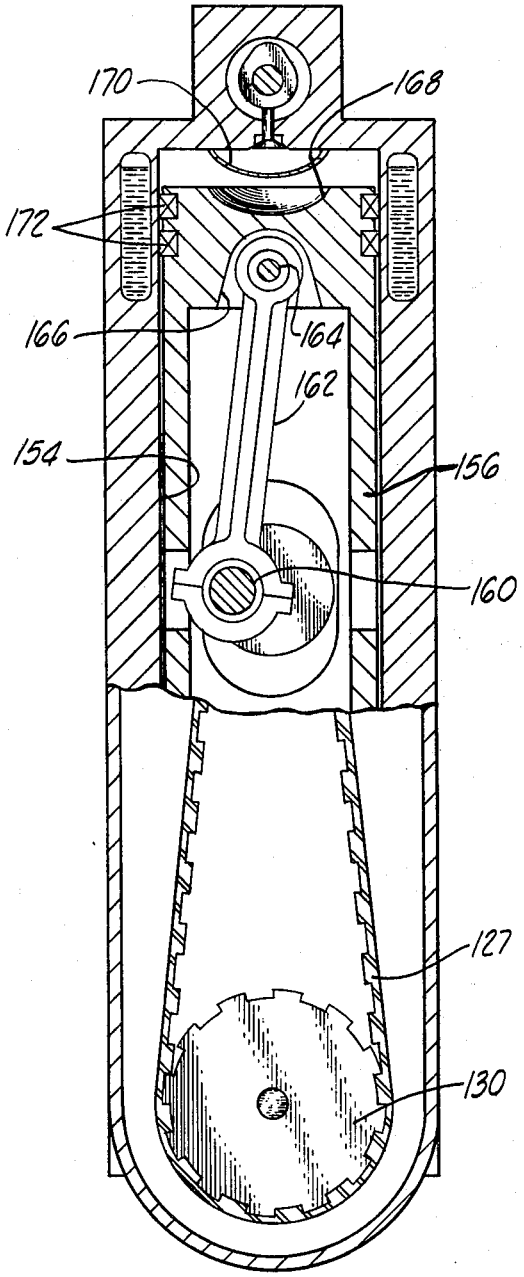
FIG. 10 is a side sectional view, partially broken away, of the engine of FIGS. 8 and 9, taken along the line 10—10 in FIG. 8 and looking in the direction of the appended arrows.

A specific example of a multicylinder engine suitable for vehicular use is illustrated in FIGS. 8–10, to which reference is now made. The configuration shown represents, by itself, the equivalent of a 2-cylinder engine in that it has 2 power pistons. Despite the out of phase movement of the power piston and displacer in systems of this type, the double ended single cylinder unit of FIGS. 8–10 is not subject to high dynamic loads. However the unit shown may be a portion of a multicylinder engine, inasmuch as a 4-cylinder engine utilizing two of the units in side-by-side relationship is inherently balanced.

In the arrangement of FIGS. 8–10, some of the principal elements having substantially direct equivalent to the arrangements previously described are similarly numbered. Thus power pistons 14 and displacer pistons 16 are disposed in a common cylinder bore defined by the cylinder 26, in which are incorporated cooling water jackets 47 and a regenerator 44. However, the common cylinder bore receives a double ended power piston 14 about a central crankshaft 66, there being upper and lower displacers 16 respectively, each in facing relation to a high temperature chamber 40 at a cylinder head end, in which are mounted a sparkplug 60 and fuel injector 61 in operative relation. The housing 12 for this system mounts the central crankshaft 66 in a set of three main bearings 120, terminal ones of which are mounted in end walls, with the middle set of bearings 120 being disposed in an intermediate wall 122. The compressor-expander system is disposed in side-by-side relationship to the common cylinder for the power unit, between the intermediate wall 122 and the opposite end wall for the housing 12. A drive pulley 124 at one end of the crankshaft 66 is coupled by a pair of belts 126, 127, here of the flexible link belt type, coupling to spaced apart driven pulleys 128, 130 respectively. The terms "upper" and "lower" are utilized hereafter in the description with respect to the orientation in the Figures to define a particular half of a given piston, displacer or compressor expander pair, even though it will be recognized that the engine may be mounted in any attitude. Thus the upper drive pulley 128 couples to an upper camshaft 132 controlling the flow of air into the upper compressor expander portion, while the lower driven pulley 130 rotates a lower camshaft 134 providing a similar function.

Considering first the double ended power piston and displacer arrangement, piston crank throws 136 adjacent the end and intermediate bearings 120 respectively support crank pins 138 on which are mounted connecting rods 140 that are disposed in spaced apart relation, but symmetrically, with respect to the center axis of the double ended power piston 14. Each connecting rod 140 is coupled to a wrist pin 142 mounted on a different side of the central axis of the power piston 14. Thus the double ended power piston 14 is reciprocated in the common cylinder bore through a stroke determined in conventional fashion by the effective length of the throws 136. The mechanism for reciprocating the proper phase relation to the associated piston sections is provided by a centrally disposed mechanism mounted between the connecting rods 140, and symmetrical with respect to the displacer rod 20 for each of the upper and lower displacers 16. The intermediate section along the axis of the upper and lower displacer rods 20 is best seen in FIG. 9, along with FIG. 8. An expanded bifurcated section 144 interconnects the upper and lower displacer rods 20 and has a central longitudinal aperture as seen in the view of FIG. 8, within which is disposed a connecting rod 146 coupled to a displacer wrist pin 148 (FIG. 9 only) that is seated in the bifurcated section 144. A crank pin 150 coupled to the opposite end of the connecting rod 146 is journaled at its opposite ends in intermediate crank throws 152 that correspond to the power piston crank throws 136.

It is evident that the opposite upper and lower ends of the double ended piston 14 reciprocate in directly out of phase relationship with respect to the associated upper and lower pressure volumes 33 with which they communicate. The displacers 16 also, being on a common central structure, reciprocate in directly out of phase relationship with respect to each other. Therefore, by selection of a proper phase relationship for a given end of the power piston 14 and its associated displacer 16, through the relative angle between the respective crank throws, this double ended arrangement provides, in effect, a pair of Stirling engines.

The compressor-expander unit described hereafter represents a single stage unit although in many instances a two-stage system is desirable. The compressor-expander unit provides the necessary buffering between ambient atmosphere and the high internal pressure desired for vehicular installation. Because practical considerations limit the amount of compression that can be achieved in a single piston stage, higher pressurization is typically achieved by the use of more than one stage. Inasmuch as the stages may be identical except for size, however, only one has been shown herein, and it is to be expressly understood that the use of two or more stages of compression and expansion may alternatively be employed.

In the compressor-expander portion, the intermediate wall 122 and the side and end walls of the housing 12 define a common cylinder bore 154 for a double ended compressor-expander piston 156. The piston 156 includes a central aperture for receiving the crankshaft 66 and a pair of crank throws 158 supporting a crank pin 160. A connecting rod 162 couples the crank pin 160 to a wrist pin 164, specific reference being made here to the side and end sectional view of FIGS. 8 and 10 respectively. Again, the upper and lower portions of the similar halves of the construction are similarly numbered for simplicity and will be referred to where appropriate or necessary with respect to the orientation of the Figures. Each closed end of the compressor-expander piston 156 includes, on its interior side, a recess 166 for receiving the wrist pin end of the connecting rod, and is in the form of a hollow cylinder. The piston head has a generally planar boundary, but includes a central recess 168 of arcuate concave shape for receiving an adjacent regenerator screen 170 that is disposed across a portion of the end of the cylinder bore. Piston rings 172 prevent bypass and provide lubrication of the cylinder walls in conventional fashion.

Reference will be made hereafter, with respect to the camshaft and valve system, to either the upper or lower portions of FIG. 8, as appropriate, for the different elements depicted. Camshafts 132, 134 are mounted in camshaft bearings 174, and each include a group of four cam surfaces 176 to 179 respectively, each controlling a different valve 182 to 185 respectively and providing a different function in the flow of working fluid into and out of the system. Details of the valve structures, such as valve lifters, valve springs and valve stems have not been shown in detail in order to simplify the drawings, inasmuch as these may be of any of a number of conventional forms. However, each of the valves 182 to 185 respectively is seated in a different valve port, and couples to a different manifold system. With reference to the upper portion of FIG. 8 specifically, the first valve 182 couples to an interior passageway in the housing 12 that forms part of an exhaust manifold 188. The fourth valve 185, which is shown in the open position, couples to an interior passageway forming a part of the inlet manifold 190. A throttle control 192, illustrated generally as a valve, is disposed in the inlet manifold 190 for controlling the rate of incoming flow, and thereby ultimately controlling the pressure in the interior of the engine. Note that both the first and fourth valves 182 and 185 respectively are disposed outside the area of the regenerator screen 170, whereas both the second and third valves 183, 184 are disposed inside the volume of the regenerator screen 170, such that working fluid between the piston 156 and the end wall of the structure must pass in heat exchange relation through the regenerator screen 170 in going to and from the passageways associated with the second and third valves 183, 184 respectively. The passageway systems for these valves are best seen in the lower half of the compressor-expander structure in FIG. 8. An interior passageway 193 in the housing 12 couples the port for the second valve 183, shown in the open state, to the pressure volume 33 in the adjacent lower portion of the power piston system. A separate valve passageway 194 couples the port associated with the third valve 184 to the same interior volume 33.

An outer coolant jacket 196 is disposed in the housing 12 about each end of the double ended compressor-expander piston 156, so as to eliminate excess heat.

It will be noted, with respect to the relative sizes of the drive pulley 124 and driven pulleys 128 and 130 in FIGS. 8 and 10, that a stepdown in drive speeds is utilized. This stepdown gives a 2:1 reduction in speed, so that each valve 182 to 185 in the compressor-expander section operates only once with respect to each two reciprocations of the piston 14 and displacer 16 in each half of the power generating section.

The operation of each half of the power generating portion of the system, the Stirling engine, is in general accordance with the examples previously discussed, and therefore need not be reviewed in detail. Control and replenishment of the working fluid are, however, achieved by a reliable and high efficiency combination of the compressor-expander piston 156 and the valving system, both the upper and lower portions of which operate in the same fashion. As previously discussed, a lean mixture is constantly maintained in the combustion or high temperature chamber of the engine, so that only a small proportion of fresh working fluid is fed in and a corresponding small portion of the existing mixture is extracted, with respect to each cycle. Whether this effective substitution of new working fluid has a different periodicity than the operation of the Stirling cycle engine is not significant, as long as the temperature variations in the high temperature chamber do not become excessive. Thus the stepdown ratios established by the ratios of the drive pulley 124 to the driven pulleys 128, 130 is arranged to operate each valve 182 to 185 once for every other cycle of the compressor-expander piston, which is reciprocated at the same rate as the piston 14 and displacers 16 in the associated engine portion.

The compressor-expander system operates into and out of an ambient pressure environment, while communicating with the associated engine only at pressures consistent with the internal working pressure of the engine. In FIG. 8, the compressor-expander piston 156 is shown at the approximate mid-point in its downward travel, in which the upper chamber is expanding in volume and the lower chamber is diminishing in volume. In the upper chamber, the fourth valve 185 is open, so that air is being drawn in through the inlet manifold 190 and the throttle control 192. The rate of intake of air, for a given instantaneous speed, is governed by the variable impedance introduced by the throttle control 192, which therefore determines the pressure reached in a subsequent compression cycle of the piston 156, and subsequently controls the effective working pressure in the engine. As previously described, control of the injected fuel (not shown) is coordinated with the throttle control and determines the work output of the engine for a given throttle setting. In the lower half of the compressor-expander system, the second valve 183, which is coupled to the valve passageway 192, is open during a compression movement of the lower piston half, forcing air into the associated engine half.

It should be noted that in the compression of ambient air, as shown for the lower compression chamber, heat is generated by the work of compression. A substantial part of this heat is transferred to the screen regenerator 170 that encompasses the second and third valves 183, 184 during the input of air under pressure to the engine. When the piston is at the full extent of its travel toward the minimum volume relationship, the screen regenerator 170 nests in the recess 168 in the facing end of the piston 156. In conventional fashion, the stroke and compression ratio of the piston are arranged with respect to the open times of the valves, so as to receive and eject a predetermined mass of working fluid within a pressure range related either to the ambient or working pressures, as appropriate. Alternately the valves associated with the conforming function may be arranged in conventional compressor fashion so that the differential pressure across a valve provides the force for opening the valve and maintaining the closed position.

On the next expansion motion of the compressor-expander piston 156, after the second valve 183 has closed during the previous compression movement, the third valve 184 is open so as to receive some of the working fluid mixture from the interior of the engine, again in a predetermined amount determined by valve timing. Finally on the next compression stroke, the first valve 182 is opened so that the gases are exhausted to the atmosphere through the exhaust manifold 188. In each compression stroke, heat is stored in the associated screen regenerator 170, this heat being given up in the succeeding expansion stroke. This conservation of heat energy greatly reduces the amount of work required to move the piston 156, thus enhancing the work output from the engine as a whole.

The back-to-back piston and displacer system in FIGS. 8-10 has advantages in terms of compactness, but additionally has substantial practical advantages in increasing the ratio of useful to dead work. In the Stirling engine, and in engines in accordance with the invention, the working volumes are maintained at substantial pressure at all times, typically in excess of 100 psi. The bearings therefore must support a high pressure load at all times to produce useful power flow during the power stroke. In the prior art, the usual way of increasing the ratio of useful to dead work was to pressurize the crankcase to a corresponding pressure to the working volume. This has a tendency to force lubricating oil into the combustion chamber, inasmuch as the crank case pressure may at times exceed that of the working volume, and the presence of lubricating oil in excess amounts in the working volume causes both excessive oil consumption and tends to clog the working elements. Even more seriously from the standpoint of the Stirling engine, however, pressurizing of the crankcase introduces a significant external volume that must also be changed in pressure when the working volume pressure is changed. In the specific example of FIGS. 8–10, throttling is achieved by varying the pressure in the working volume, as previously described, and this is the most efficient manner of changing work output for Stirling engines in general. In addition, a fast response to throttling is highly desirable for vehicular applications because of the need for acceleration and deceleration in traffic. Response rates are greatly slowed by any substantial increase introduced by pressurization of crankcase volumes.

The response rate or time constant of an engine is best expressed in terms of the rate at which significant changes in torque level can be effected. In practical examples of devices in accordance with the invention, the time constant involved in changing between different torque levels has been reduced from the figure of the order of several seconds, typical of the Stirling engines of the conventional type, to fractions of a second. These advantages are derived because only the working volume need be altered in pressure, and because this change in pressurization is effected solely by changing the rate of gas flow (with concurrent change of fuel supply rate).

High crankcase pressures are also not required in this example, inasmuch as the pressures on the opposite piston faces are in opposition, so that bearing loads are determined by the difference in forces. The ratio of peak pressure difference to average pressure difference across the piston faces is greatly reduced, and ratios of 1.5:1 to 2.0:1 are achieved, effectively eliminating the need for a high crankcase pressure.

In the compressor-expander piston system, the push-pull arrangement also reduces the average bearing load. Moreover, the storage of heat of compression, and the use of working volume pressure in one end while the other end is in a compression stroke, achieve a balanced operation that greatly reduces the work demands of the compressor-expander piston. In addition the complexity of the structure, and the number of moving parts, are both reduced.

The arrangement of FIGS. 8–10 represents a practical example where a number of specific values and relationships were utilized and these are given herein for completeness. The phase angle relationship of the crank throw angles employs a 90° displacement between the displacer and the power piston. That is, with the piston at its top dead center position being taken at zero angle, the displacer is at the 90° position (in other words leading by 90°) and the compressor-expander at the 135° position. In the push-pull arrangement, the opposite elements are in phase opposition to the positions given and therefore 180° out of phase. The engine stroke in this example is approximately 1 ⅝ inches, although the general rule may be observed that the strokes for engines of various sizes are approximately one-half those used for Otto engines, varying from approximately ⅝ inches for moderately small engines to approximately 3 inches for large engines. The pressure ratio variation, peak-to-peak, was approximately 2.2:1 to 2.3:1, this being the ratio of the highest to lowest pressures in the pressure volume.

The air:fuel mixture used a ratio based on incoming air at idle of approximately 18:1, this mixture becoming leaner at higher torque outputs, with the temperature being held constant. The operating temperature of the engine was approximately 1500° F. ± 100° F. for this vehicular application; the engine speed at peak power was approximately 5500 rpm, although short term maximums of approximately 6500–7000 rpm can be reached. With a single stage compressor, the internal engine pressure at full throttle, low pressure point in the cycle, is approximately 8 atmospheres. Because a larger engine having slightly less efficiency and less smooth operation is required for the same power output with a single stage compressor-expander unit, a twostage unit is typically preferred for vehicle use. The two-stage compressor-expander provides internal operating pressures, at the low pressure point in the cycle, of approximately 75 psi when idling and approximately 375 psi at full throttle.

Methods in accordance with the invention utilize the controlled extraction of work energy from a heated relatively heavy gas mixture maintained, in its high temperature portion, at a sufficient level to support efficient combustion. In the internal combustion system the gas mixture contains a combustible portion. The internal mixture is maintained at high pressure, and the combustible portion is maintained in a high ratio to the total mix, with new combustible gas being added as working fluid is extracted in minor amounts, both at the operative pressure level. Although specific units have been shown having the advantages in terms of compactness and operating efficiency, it will be appreciated that the methods are applicable to all types of engines utilizing the Stirling system.

Methods and structures in accordance with the invention are also applicable to systems that do not employ internal combustion, but supply the thermal energy in the form of a high temperature working fluid. The conventional external combustion Stirling engine, which requires a high thermal conductivity interior gas as well as heat transfer into the gas cannot typically be operated at sufficient efficiency to justify its usage in this context. However, engines in accordance with the invention can utilize such a fluid directly inasmuch as the limitation of utilizing a heavy gas has been overcome, and inasmuch as the interior gas volume is substantially isolated and does not engender significant amounts of steady state heat dissipation. The ability to use the thermal energy heretofore wasted in the form of work output can significantly increase the efficiency of such nuclear reactor installations.

Although a number of alternative arrangements and features, and uses of systems and methods in accordance with the invention, have been shown and suggested, it will be appreciated that the invention is not limited thereto, but encompasses all modifications and variations falling within the scope of the appended claims.

What is claimed is:

1. A hot gas engine system for providing work energy comprising:

means defining a hot gas volume containing air;

means for burning fuel in the hot gas volume comprising catalyst means disposed in communication with the interior of the hot gas volume;

means disposed adjacent the hot gas volume for providing a high thermal gradient interior boundary thereabout;

means in communication with the hot gas volume for varying the volume thereof in cyclic fashion;

means defining a low temperature gas volume in communication with the hot gas volume;

means coupled to the low temperature gas volume for substituting relatively small increments of air for corresponding increments of the air mixture therein at substantially corresponding temperature and pressure;

adjustable air flow control means coupled to said means for substituting air;

piston means in communication with the low temperature gas volume for varying the volume thereof in timed relation to the variations in the hot gas volume;

thermal regenerator means intercoupling the hot gas volume and the lower temperature chamber to provide gas flow therebetween during changes of volume, said thermal regenerator means having a high area relative to the path length therethrough;

means coupling to said means defining a hot gas volume for releasing thermal energy internally therein; and means coupled to the piston means for deriving work energy from the system.

2. An internal combustion Stirling cycle engine comprising:

air mixture chamber means including a high temperature portion and a low temperature portion;

reciprocating displacer means and piston means each communicating with said chamber means to change the interior volume thereof;

means for reciprocating said displacer means and piston means in a selected phase relation; and regenerator means between the high temperature and low temperature portions of said chamber means, said regenerator means comprising a large area, short path length structure, having a path length-to-area ratio of less than approximately ten times the swept volume with the swept volume expressed in cubic centimeters and the length-to-area ratio expressed in reciprocal centimeters, said regenerator means having a length of approximately 1 cm. or less

3. An internal combustion Stirling cycle engine comprising:

air mixture chamber means including a high temperature portion and a low temperature portion;

reciprocating displacer means and piston means each communicating with said chamber means to change the interior volume thereof;

means for reciprocating said displacer means and piston means in a selected phase relation; and regenerator means between the high temperature and low temperature portions of said chamber means, said permeable insulation means comprising self supporting refractory fibers disposed on the interior surface of the high temperature portion of said air mixture chamber means and on the opposed surface of said displacer means.

4. An internal combustion Stirling cycle engine comprising:

air mixture chamber means including a high temperature portion and a low temperature portion;

reciprocating displacer means and piston means each communicating with said chamber means to change the interior volume thereof;

means for reciprocating said displacer means and piston means in a selected phase relation;

regenerator means between the high temperature and low temperature portions of said chamber means;

means for establishing combustion within said chamber means; and compressor and expander means for replenishing and extracting air mixture at a controlled rate and substantially at the internal pressure of the engine, said compressor and expander means operating in timed relation to said displacer means and piston means, and further including regenerator means coupling said compressor and expander means in common to said air mixture chamber means.

5. The invention as set forth in claim 4 above, including in addition air flow control means coupled to said compressor and expander means.

6. The invention as set forth in claim 5 above, wherein said compressor and expander means comprise a pair of pistons, means for reciprocating said pistons in timed relation to said displacer means and piston means, and valve means operating in timed relation to said piston means and coupled to provide communication between each of said piston means and said regenerator means.

7. A Stirling cycle engine comprising:

displacer means including a reciprocable displacer element and an encompassing chamber, therefor, and first drive means coupled to said element;

piston means including a reciprocable piston and an encompassing cyclinder therefore, and second drive means coupled to said piston, said displacer means and piston means repetitively cycling the working fluid between said chamber and said cylinder;

crankshaft means coupled to said first and second drive means;

means including a pressurized working fluid for establishing combustion with said chamber;

regenerator means coupling said chamber to said cyclinder and providing communication therebetween;

air flow control means coupled to said expander compressor means for controlling the internal pressure in said engine;

and compressor-expander means coupled to said second drive means and communicating with the interior of said cylinder to substitute working fluid for products of combustion, said compressor-expander means selectively substituting working fluid such that the working fluid cycles on the average at least 10 times before extraction from the system.

8. The invention as set forth in claim 7 above, wherein the working fluid is air and the temperature in said chamber is limited to less than approximately 1700° F.

9. A hot gas engine system comprising the combination of:

air mixture chamber means including a high temperature portion and a low temperature portion and confining a combustible working fluid at high pressure;

regenerator means between the high temperature and low temperature portions of said chamber means;

means disposed adjacent said chamber means for cycling the working fluid between said high temperature and low temperature portions to extract work therefrom;

means coupled to the high temperature portion of said chamber means for establishing combustion therein;

means coupled to the low temperature portion of said chamber means for substituting new working fluid for working fluid containing products of combustion at the internal pressure of said chamber means and at the low temperature level, comprising volume changing means; and thermal regenerator means in the flow paths between new working fluid and fluid containing products of combustion.

10. In a hot gas Stirling engine having a high temperature chamber for a working fluid subject to pressure changes, and a displacer in communication with the high temperature chamber, the exterior wall of said chamber being cooled, the improvement comprising:

means disposed on the interior walls of the chamber, said means permitting limited interior movement of the working fluid therein and having a low thermal conductivity in the direction transverse to the interior wall, said means comprising a finely subdivided matrix of intercoupled filamentary elements having a melting point of in excess of 2000° F. comprising a layer of fabric of refractory material disposed on the facing walls of the high temperature chamber and the displacer.

11. The invention as set forth in claim 10 above, wherein said insulation comprises fibrous ceramic material less than approximately ⅛ inch in thickness and said engine includes relatively light weight, high conductivity metal defining the outer wall of said hot chamber and in direct areal contact with said layer of insulation.

12. In a hot gas-engine having a hot chamber and a relatively low temperature chamber, a regenerator system coupling said hot chamber and said relatively low temperature chamber comprising a regenerator having a path length-to-area ratio of less than approximately ten times the swept volume with the swept volume expressed in cubic centimeters and the length-to-area ratio expressed in reciprocal centimeters, said hot gas engine using a relatively low thermal conductivity gas such as air as a working fluid, and the path length of said regenerator being less than approximately 1 cm.

13. The invention as set forth in claim 12 above, wherein said regenerator comprises refractory particulates containing catalyst material.

14. The invention as set forth in claim 13 above, wherein said regenerator comprises layers of metal mesh.

15. In a hot gas engine having a hot chamber and a relatively low temperature chamber, a regenerator system coupling said hot chamber and said relatively low temperature chamber comprising a regenerator having a path length-to-area ratio of less than approximately ten times the swept volume with the swept volume expressed in cubic centimeters and the length-to-area ratio expressed in reciprocal centimeters, wherein said regenerator is annular in form and defines a portion of a frustum.

* * * * *

UNITED STATES PATENT AND TRADEMARK OFFICE

CERTIFICATE OF CORRECTION

PATENT NO. : 4,004,421

DATED : January 25, 1977

INVENTOR(S) : Kenneth W. Cowans

It is certified that error appears in the above-identified patent and that said Letters Patent are hereby corrected as shown below:

Column 1, line 5, "far" should read --for--. Column 2, line 30, after "evidenced" insert a comma --,--; line 30, after "in" delete the semicolon (";"). Column 4, lines 43 & 44, after "typical" and before "engines" insert --vehicular--. Column 6, line 34, after "relation", "of" should read --to--. Column 7, line 18, before "temperature" insert --high--. Column 10, equation (4) should read $$\text{--Work} \quad \frac{\bar{\dot{m}}\,\overline{\Delta P}}{\bar{\rho}} \text{ --}$$

Column 10, line 36, "m" should read --$\bar{\dot{m}}$--; line 37, "$\rho$" should read --$\bar{\rho}$--; line 38, "$\Delta P$" should read --$\overline{\Delta P}$--; line 54, after "K'" insert -- $\equiv$ --
. Column 11, line 7, "1/4" should read --2/3--; line 10, after "$\mu$" and before "viscosity"insert -- $\equiv$ --; line 11, after "k" and before "thermal conductivity" insert -- $\equiv$ --; line 25, after "S" insert -- $\equiv$ --; line 26, after "l" insert -- $\equiv$ --; line 32, "$Q\chi_{reg}$" should read --$Q\chi_{reg}$--;

UNITED STATES PATENT AND TRADEMARK OFFICE

CERTIFICATE OF CORRECTION

PATENT NO. : 4,004,421

DATED : January 25, 1977

INVENTOR(S) : Kenneth W. Cowans

It is certified that error appears in the above-identified patent and that said Letters Patent are hereby corrected as shown below:

Column 11, equation (11) should read $$--V \sim \frac{1}{S} \quad \frac{1}{\sqrt{\rho}} \quad --$$

Column 11, line 66 should read $--\sim \frac{1}{\rho}$ , --.

Column 12, line 1, before "is invariant" insert $--\dot{Q}K_{reg}--$.

Column 14, line 63, "20°" should read --20'--. Column 21, line 3, "twostage" should read --two-stage--. Column 23, line 20, "therefore" should read --therefor--; line 32, after "expander" insert a hyphen -- - --.

Signed and Sealed this

Twenty-first Day of June 1977

[SEAL]

*Attest:*

RUTH C. MASON
*Attesting Officer*

C. MARSHALL DANN
*Commissioner of Patents and Trademarks*